US009157335B2

(12) United States Patent
Kundram et al.

(10) Patent No.: US 9,157,335 B2
(45) Date of Patent: Oct. 13, 2015

(54) SIDE SUPPORTED TURBINE SHELL

(75) Inventors: Mukil Kundram, Bangalore (IN); Mani Bhaskar, Bangalore (IN); Sudatta Dash, Bangalore (IN)

(73) Assignee: General Electric Company, Schenectady, NY (US)

( * ) Notice: Subject to any disclaimer, the term of this patent is extended or adjusted under 35 U.S.C. 154(b) by 831 days.

(21) Appl. No.: 13/430,787

(22) Filed: Mar. 27, 2012

(65) Prior Publication Data

US 2013/0259663 A1 Oct. 3, 2013

(51) Int. Cl.
*F04D 29/40* (2006.01)
*F01D 25/28* (2006.01)

(52) U.S. Cl.
CPC ..... *F01D 25/28* (2013.01)

(58) Field of Classification Search
CPC ..... F01D 25/28; F01D 25/285; F01D 25/24; F04D 29/40
USPC ..... 415/108, 214.1, 215.1, 219.1, 216.1, 415/222, 203, 182.1
See application file for complete search history.

(56) References Cited

U.S. PATENT DOCUMENTS

| | | | | |
|---|---|---|---|---|
| 3,881,843 | A | 5/1975 | Meylan | |
| 4,050,660 | A | 9/1977 | Eggmann et al. | |
| 4,311,016 | A | 1/1982 | Kaelber | |
| 4,456,426 | A | 6/1984 | Bellati | |
| 4,732,533 | A | 3/1988 | Remberg et al. | |
| 5,104,289 | A | 4/1992 | Moreci | |
| 5,108,258 | A * | 4/1992 | Gros | 415/213.1 |
| 2005/0060120 | A1 | 3/2005 | Eisenzopf | |
| 2010/0329837 | A1 | 12/2010 | Cooper et al. | |
| 2011/0142605 | A1 * | 6/2011 | Koza et al. | 415/182.1 |

FOREIGN PATENT DOCUMENTS

| | | | |
|---|---|---|---|
| CN | 102108885 | A | 6/2011 |
| JP | 2001003708 | A | 1/2001 |

OTHER PUBLICATIONS

Unofficial English Translation of Chinese Office Action issued in connection with corresponding CN Application No. 201310101553.1 on May 27, 2015.

* cited by examiner

*Primary Examiner* — Edward Look
*Assistant Examiner* — Maxime Adjagbe
(74) *Attorney, Agent, or Firm* — Sutherland Asbill & Brennan LLP

(57) ABSTRACT

The present application provides a steam turbine side support system for use with a steam turbine having a rotor. The steam turbine side support system may include a shell for the steam turbine, a number of side support arms extending from the shell in a perpendicular configuration with respect to the rotor, and a foundation in communication with the side support arms.

15 Claims, 4 Drawing Sheets

Fig. 3
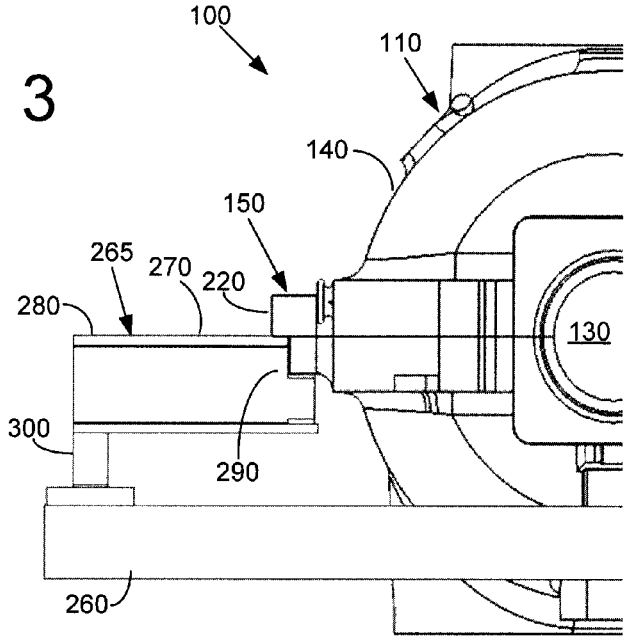
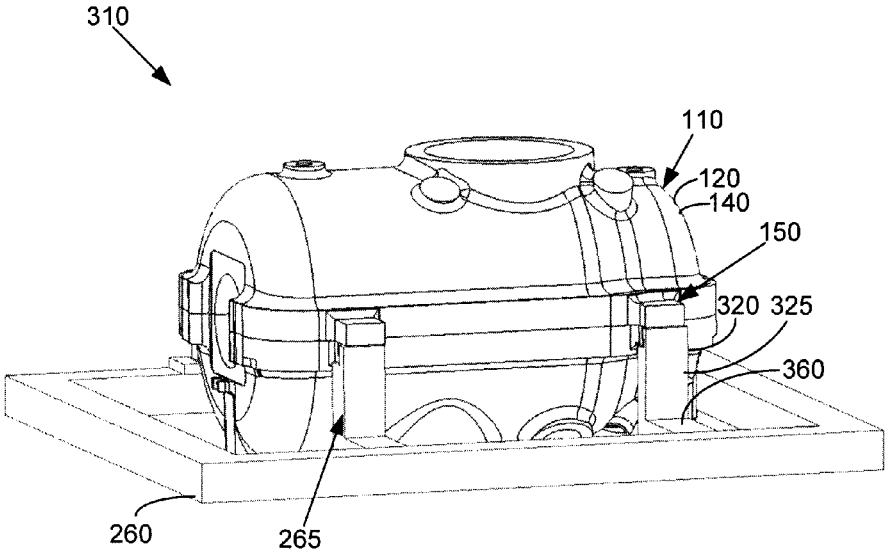
Fig. 4

SIDE SUPPORTED TURBINE SHELL

TECHNICAL FIELD

The present application and the resultant patent relate generally to turbo-machinery and more particularly relate to a turbo-machine such as a steam turbine having a number of side support arms to support the shell of the steam turbine for reduced deflection.

BACKGROUND OF THE INVENTION

A concern in the design of turbo-machines such as steam turbines is the accommodation of thermal distortion or deflections, particularly during transient events. For example, seals within a steam turbine may include a number of teeth on a stationary component that interlace with lands on a rotating component. The radial gaps between the stationary components and the rotating components are designed to be as narrow as possible so as to minimize steam leakage. Deflection of the shell may cause the rotating components to come in contact with the stationary seals. Specifically, seal clearances between the rotating components and the stationary components may close in at the base and tend to open in the cover of the shell in a phenomenon referred to as humping. If the extent of the humping is severe enough, undesirable rubbing and component damage may occur.

Steam turbine shells generally may be supported by a number of shell arms extending axially about both ends of the shell in a direction parallel to the rotor. Turbine humping may be intensified in that the support arms largely may act as pivot points. Moreover, the shell arms also may experience thermal gradients therein so as to cause further deflections.

There is thus a desire for an improved turbo-machine such as a steam turbine with enhanced accommodation for thermal distortions, particularly during transient events. Such an improved turbo-machine may eliminate or reduce turbine humping so as to facilitate smaller radial seal clearances for improved overall performance and efficiency. Moreover, eliminating or reducing the opportunities for turbine humping also should facilitate longer component lifetime with reduced wear and damage.

SUMMARY OF THE INVENTION

The present application and the resultant patent thus provide a steam turbine side support system for use with a steam turbine having a rotor. The steam turbine side support system may include a shell for the steam turbine, a number of side support arms extending from the shell in a perpendicular configuration with respect to the rotor, and a foundation in communication with the side support arms.

The present application and the resultant patent further provide a steam turbine side support system for use with a steam turbine having a rotor. The steam turbine side support system may include a shell for the steam turbine, a number of side support arms extending from the shell in a perpendicular configuration with respect to the rotor, a foundation, and a number of horizontal supports connecting the side support arms to the foundation.

The present application and the resultant patent further provide a steam turbine side support system for use with a steam turbine having a rotor. The steam turbine side support system may include a shell for the steam turbine, a number of side support arms extending from the shell in a perpendicular configuration with respect to the rotor, a foundation, and a number of vertical supports connecting the side support arms to the foundation.

These and other features and improvements of the present application and the resultant patent will become apparent to one of ordinary skill in the art upon review of the following detailed description when taken in conjunction with the several drawings and the appended claims.

BRIEF DESCRIPTION OF THE DRAWINGS

FIG. 3 is a side plan view of the steam turbine side support system of FIG. 1.

FIG. 4 is a perspective view of an alternative embodiment of a steam turbine side support system as may be described herein.

DETAILED DESCRIPTION

Figure 1:
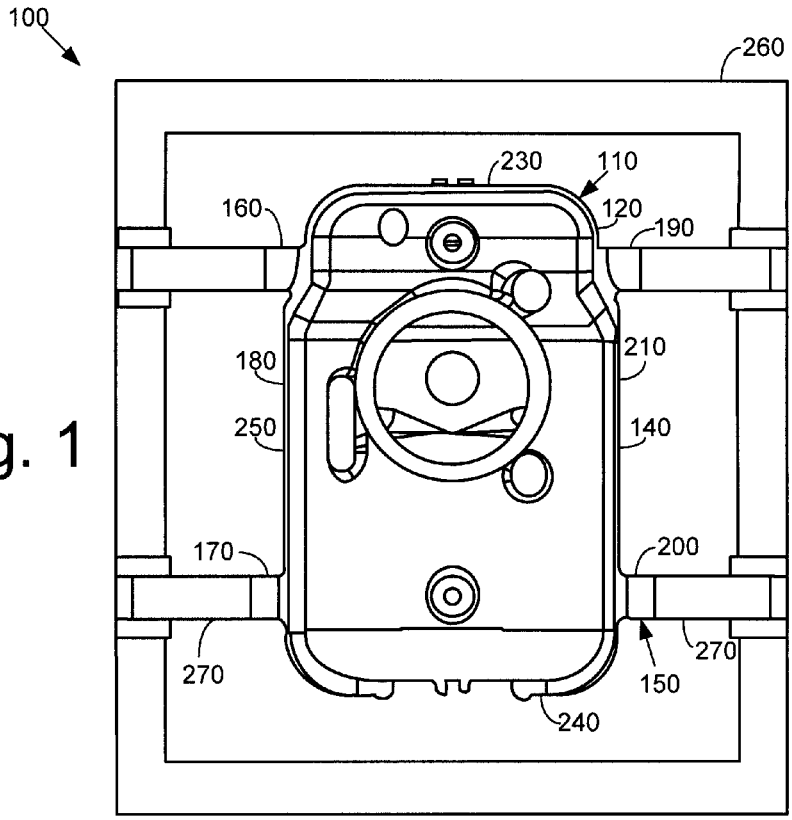
FIG. 1 is a top plan view of a steam turbine side support system as may be described herein.
Figure 2:
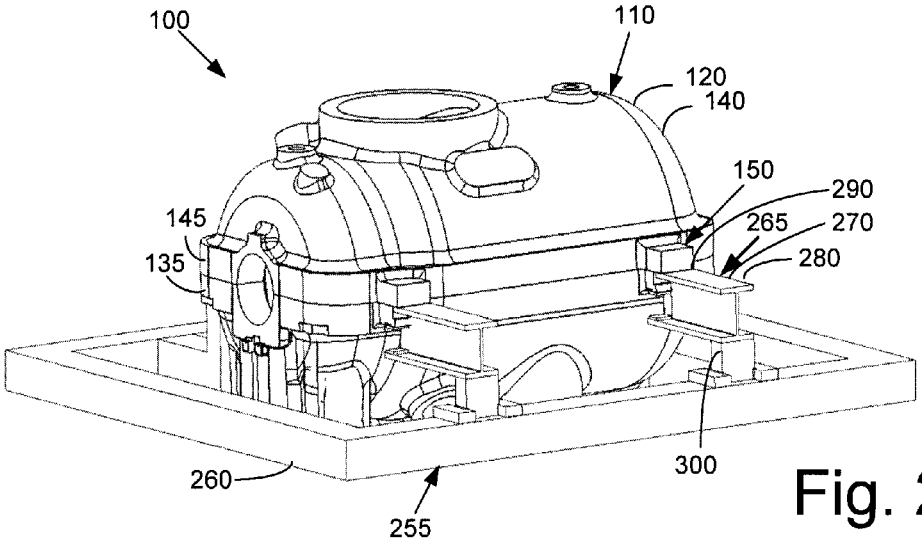
FIG. 2 is a perspective view of the steam turbine side support system of FIG. 1.

Referring now to the drawings, in which like numerals refer to like elements throughout the several views, FIGS. 1-3 show an example of a steam turbine side support system 100 as may be described herein. The steam turbine side support system 100 may include a steam turbine 110. The steam turbine 110 may have any size, shape, or configuration. Although the steam turbine side support system 100 is described in terms of the steam turbine 110, the steam turbine side support system 100 may be used with any type of turbo-machine 120 and the like.

The steam turbine 110 may include a rotor shaft 130 extending therethrough. The steam turbine 110 may be enclosed by an outer shell 140. The outer shell 140 may include a base 135 and a cover 145. Other components and other configurations may be used herein. As was described above, known steam turbines generally are supported via one or more shell arms extending in an axial direction that is parallel to the rotor shaft 130. Such axial shell arms, however, may be subject to deformation and deflection.

The steam turbine 110 includes a number of side shell arms 150. The side shell arms 150 may include a first side first arm 160 and a first side second arm 170 positioned on a first side 180 of the steam turbine 110 and a second side first arm 190 and a second side second arm 200 positioned on a second side 210 of the steam turbine 110. The side shell arms 150 may extend in a direction substantially perpendicular 220 to the direction of the rotor shaft 130. In this example, the side shell arms 150 may be closer to a first end 230 and a second end 240 than a middle 250 of the steam turbine 110 in an end placement 255 configuration. The side shell arms 150 may have any size, shape, or position. Any number of the side shell arms 150 may be used herein with at least one arm 150 extending on each side 180, 210 of the shell 140. Other components and other configurations also may be used herein.

The steam turbine side support system 100 also may include a foundation 260. The foundation 260 may be made from any type of substantially rigid, temperature resistant materials such as metals and the like. The foundation 260 may be mounted to a base or any type of support structure and/or the foundation 260 may be a free standing structure. A number of arm supports 265 may be used to connect the foundation 260 to the side shell support arms 150. In this example, the arm supports 265 may include a number of horizontal supports 270. The horizontal supports 270 may take the form of I-beams 280 and the like although any size, shape, or configuration may be used herein. The side support arms 150 may have a beam recess 290 to accommodate the upper T-shape of the I-beams 280. The bean recess 290 of the side support arms 150 may be slid into place along the I-beams 280 and attached thereto. Other types of mating and/or connection mechanisms may be used herein.

A vertical extension block 300 may connect each I-beam 280 and the foundation 260. The vertical extension block 300 may have any size, shape, or configuration. The vertical extension block 300 may be made out of any type of substantially rigid, heat resistant materials such as metals and the like. The I-beams 280 and the vertical extension block 300 may be assembled via welding or other types of conventional fastening means. Other components and other configurations may be used herein.

Figure 5:
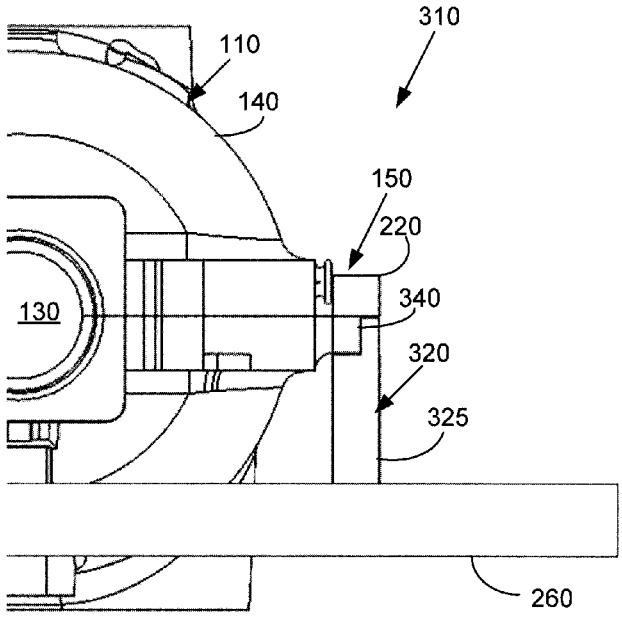
FIG. 5 is a side plan view of the steam turbine side support system of FIG. 4.
Figure 6:
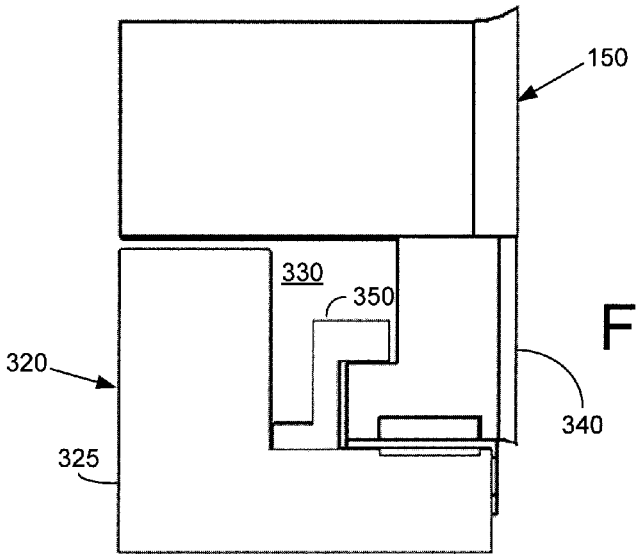
FIG. 6 is a side plan view of a shell arm and a pedestal in the steam turbine side support system of FIG. 4.

FIGS. 4-6 show an alternative embodiment of a steam turbine side support system 310 as may be described herein. The steam turbine side support system 310 may include the steam turbine 110 with the side shell arms 150. In this example, a number of vertical supports 320 may extend from the foundation 260 to the side shell arms 150 as the arm supports 265. The vertical supports 320 may take the form of pedestals 325 and the like although any size, shape, or configuration may be used herein. The pedestals 325 may be made from any type of substantially rigid, heat resistant materials such as metals and the like. As is shown in FIG. 6, each pedestal 325 may have an upper indent 330 sized to accommodate a shell arm flange 340 (or vice versa). A guide 350 may be used to accommodate the upper indent 330 and the shell arm flange 340. The shell arm flange 340 of the side support arms 150 may be slid into place along the upper indent 330 and attached thereto. Other types of mating and/or connection mechanisms may be used herein.

A horizontal extension block 360 may connect the pedestal 325 and the foundation 260. The horizontal extension block 360 may have any size, shape, or configuration. The horizontal extension block 360 may be made out of any type of substantially rigid, heat resistant materials such as metals and the like. The pedestal 325 and the horizontal extension block 360 may be assembled via welding or other types of conventional fastening means. Other components and other configurations may be used herein.

Figure 7:
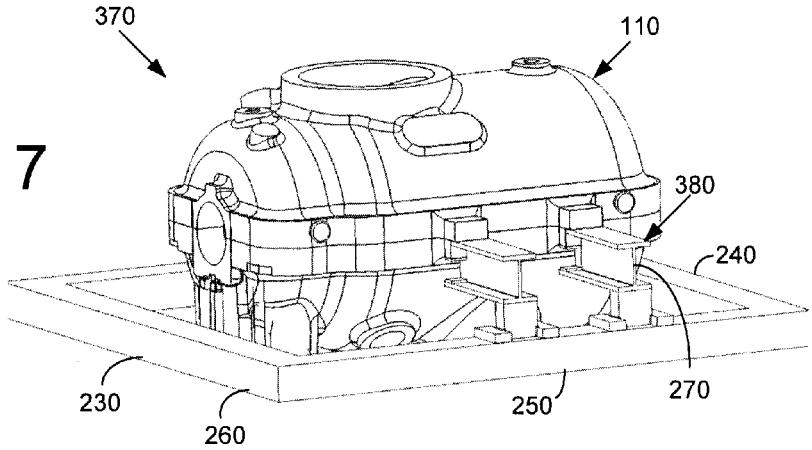
FIG. 7 is a perspective view of an alternative embodiment of a steam turbine side support system as may be described herein.

FIG. 7 shows an alternative embodiment of a steam turbine side support system 370. In this example, the steam turbine side support system 370 may use the horizontal supports 270 with the I-beams 280 of FIGS. 1-3 for support, but uses a middle placement 380 configuration with the I-beams 280 closer to the middle 250 of each side 180, 210 then the end placement 255 configuration described above. Other components and other configurations may be used herein.

Figure 8:
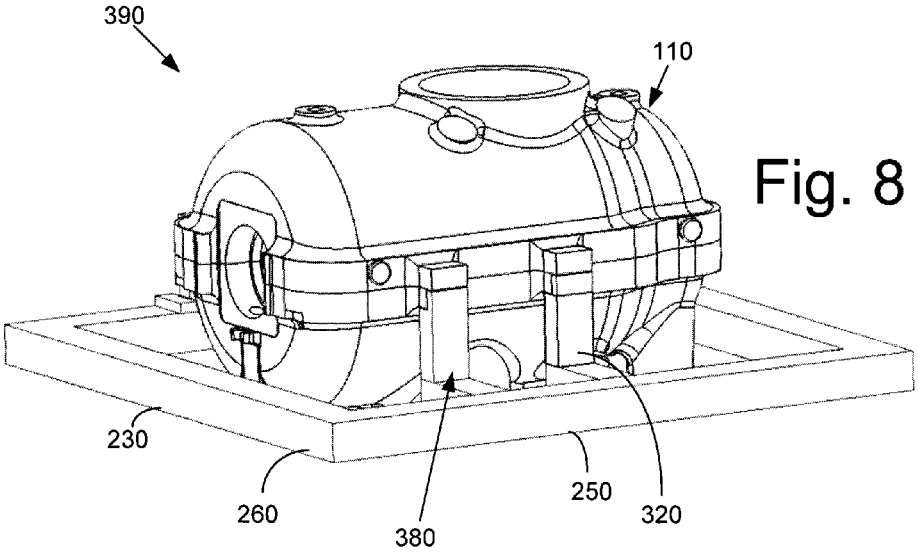
FIG. 8 is a perspective view of an alternative embodiment of a steam turbine side support system as may be described herein.

Likewise, FIG. 8 shows a further alternative embodiment of a steam turbine side support system 390. In this example, the steam turbine side support system 390 may use the vertical supports 320 with the pedestals 325 of FIGS. 4-6, but with the middle placement 380 configuration described above. Other components and other configurations also may be used herein.

The steam turbine side support systems described herein thus may provide the steam turbine 110 with a number of side support arm 150 having the perpendicular configuration 220 as opposed to the known parallel configurations. The use of the perpendicular configuration 220 may reduce the vertical deflection of the shell 140 and hence reduce turbine humping. Such a reduction may facilitate smaller radial seal clearances for improved and sustained efficiency. Moreover, temperature interaction between the side shell arms 150 and the internal seals may be eliminated and/or decreased. Specifically, the perpendicular configuration 220 may eliminate thermal gradients in and about the side support arms 150.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A steam turbine side support system for use with a steam turbine having a rotor, comprising:

a shell for the steam turbine;

a plurality of side support arms extending from the shell in a perpendicular configuration with respect to the rotor;

a foundation in communication with the plurality of side support arms; and a plurality of arm supports connecting the plurality of side support arms to the foundation wherein the plurality of arm supports comprises a plurality of I-beams.

2. The steam turbine side support system of claim 1, wherein the plurality of side support arms comprises a first side first arm and a first side second arm extending from a first side of the shell and a second side first arm and a second side second arm extending from a second side of the shell.

3. The steam turbine side support system of claim 1, wherein the plurality of side support arms comprises an end placement configuration.

4. The steam turbine side support system of claim 1, wherein the plurality of side support arms comprises a middle placement configuration.

5. The steam turbine side support system of claim 1, wherein the plurality of side support arms comprises a beam recess sized for the plurality of I-beams.

6. The steam turbine side support system of claim 1, wherein the plurality of arm supports comprises a vertical extension block positioned between the foundation and the plurality of horizontal supports.

7. The steam turbine side support system of claim 1, wherein the plurality of arm supports comprises a plurality of vertical supports.

8. The steam turbine side support system of claim 7, wherein the plurality of vertical supports comprises a plurality of pedestals.

9. The steam turbine side support system of claim 8, wherein the plurality of side support arms comprises a shell arm flange sized for an indent of the plurality of pedestals.

10. The steam turbine side support system of claim 9, wherein the plurality of pedestals comprises a guide positioned between the shell arm flange and the indent.

11. The steam turbine side support system of claim 7, wherein the plurality of arm supports comprises a horizontal extension block positioned between the foundation and the plurality of vertical supports.

12. A steam turbine side support system for use with a steam turbine having a rotor, comprising:

a shell for the steam turbine;

a plurality of side support arms extending from the shell in a perpendicular configuration with respect to the rotor;

a foundation;

a plurality of horizontal supports connecting the plurality of side support arms to the foundation; and a plurality of arm supports connecting the plurality of side support arms to the foundation wherein:

the plurality of arm supports comprises a plurality of vertical supports; and the plurality of arm supports comprises a horizontal extension block positioned between the foundation and the plurality of vertical supports.

13. The steam turbine side support system of claim 12, wherein the plurality of horizontal supports comprises a plurality of I-beams.

14. The steam turbine side support system of claim 13, wherein the plurality of side support arms comprises a beam recess sized for the plurality of I-beams.

15. A steam turbine side support system for use with a steam turbine having a rotor, comprising:

a shell for the steam turbine;

a plurality of side support arms extending from the shell in a perpendicular configuration with respect to the rotor;

a foundation; and a plurality of vertical supports connecting the plurality of side support arms to the foundation, wherein the plurality of vertical supports comprises a plurality of pedestals;

wherein the plurality of side support arms comprises a shell arm flange sized for an indent of the plurality of pedestals.

* * * * *